United States Patent [19]

Kroupa

[11] 4,368,721

[45] Jan. 18, 1983

[54] WOODBURNING STOVE

[76] Inventor: Eugene A. Kroupa, R.R. #2, P.O. Box 1830, Oliver, British Columbia, Canada, VOH 170

[21] Appl. No.: 125,629

[22] Filed: Feb. 28, 1980

[51] Int. Cl.[3] ..... F24C 1/14; F24B 3/00

[52] U.S. Cl. ..... 126/4; 126/76; 126/77; 126/289; 126/200

[58] Field of Search ..... 126/4, 76, 77, 200, 126/65, 66, 67, 289, 290

[56] References Cited

U.S. PATENT DOCUMENTS

| | | | |
|---|---|---|---|
| 175,992 | 5/1876 | Palmer | 126/4 |
| 697,091 | 4/1902 | Kistler | 126/4 |
| 762,588 | 6/1904 | Jackson | 126/4 |
| 1,190,396 | 7/1916 | Frazier | 126/4 |
| 1,464,986 | 8/1923 | Gaj | 126/4 |
| 2,196,467 | 4/1940 | Masonick | 126/4 |
| 2,579,213 | 12/1951 | Stuckey et al. | 126/76 |
| 2,794,434 | 6/1957 | Evans | 126/200 |
| 2,963,019 | 12/1960 | Domsky | 126/200 |
| 4,117,824 | 10/1978 | McIntire et al. | 126/4 |
| 4,136,662 | 1/1979 | Williams | 126/67 |
| 4,212,286 | 7/1980 | Shane | 126/77 |

FOREIGN PATENT DOCUMENTS

| | | | |
|---|---|---|---|
| 748572 | 4/1933 | France | 126/4 |
| 418902 | 5/1934 | United Kingdom | 126/4 |

*Primary Examiner*—James C. Yeung

*Attorney, Agent, or Firm*—Stevens, Davis, Miller & Mosher

[57] ABSTRACT

A wood burning stove having a lower main fire box and a vertically offset oven unit. Directly under the cooking surface of the lower firebox is an auxiliary firebox; the air supply inlet has means to selectively direct the incoming air to either firebox so that a small cooking fire can be used alone. The main firebox door has a glass panel and a removable stainless steel plate to reflect heat back to the glass to burn off accumulated deposits thereon.

20 Claims, 11 Drawing Figures

WOODBURNING STOVE

This invention relates generally to stoves or furnace for burning solid fuels and in particular a stove for burning wood or wood products. Such stoves have long been known in the prior art in various forms including a simple pot bellied stove having no interior baffle means and more complicated stoves which have varying degrees of interior baffles which are designed to extract a maximum amount of heat from the burning wood prior to discharge of the combustion gases up the chimney accompanied by smoke. The word "smoke" as used in this specification is intended to include all such combustion gases and not merely the visible component and suspended particulate matter which is generally included in the definition of this term.

The present stove is intended to perform multiple functions, that is it can be used as a heater for a house, to provide surface cooking, an oven for baking, domestic hot water and the aesthetic appeal of a fireplace by providing a fire which is readily visible to the room occupants.

It is an object of this invention to improve the efficiency of wood burning stoves so as to extract a maximum of heat from the fuel burned therein.

It is a further object of the present invention to provide an air tight stove in which the combustion rate can be closely controlled by varying the quantity of input air.

It is a further object of the present invention to provide a stove having a main firebox and an auxiliary firebox which can be separately loaded and ignited from the main firebox without the necessity for separate lighting. The auxiliary firebox is positioned directly under the cooking top so that extra heat can be applied to the top when needed or a relatively small fire can be used for cooking without the necessity of heating the entire room when it is not needed.

Another object of the present invention is to provide a stove having an oven which is vertically offset from the firebox portion of the stove so as to insure more uniform heat distribution for even baking while leaving the top of the firebox portion free for cooking use.

Another object of this invention is to provide a stove which can be placed in the center of a room and used from either side having glass doors where the fire is readily visible for aesthetic purposes and the oven contents can be viewed from either the front or the back.

Other objects and advantages of the present invention will become apparent upon a review of the following specification in which a preferred embodiment is described by a way of example only, and not of limitation, as exemplified by the following drawings in which.

Figure 1:
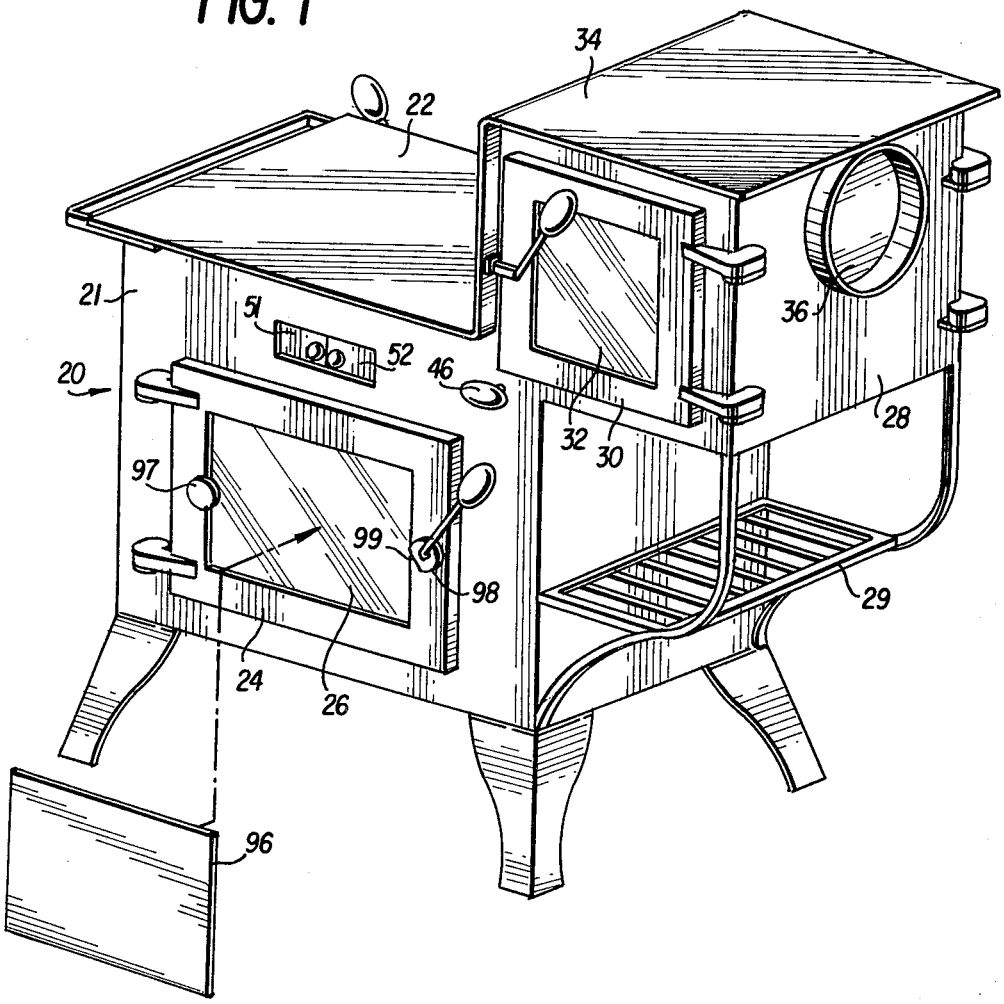
FIG. 1 is perspective view of a preferred embodiment of the present stove.

Turning now to the drawings in greater detail, in FIG. 1 the stove is generally designated by a reference numeral 20 and has a lower firebox unit 21 having a cooking top 22 and a main door 24 which has a viewing glass 26. This glass is preferably Corning "Vycor" (Trade mark) or similar glass which is designed to withstand a temperature of 2000° F. and thus can be immediately adjacent the burning fire with a minimum danger of breakage.

Above and vertically offset from the firebox unit is oven unit 28 which has a front door 30 with a conventional Pyrex oven door glass 32. The oven preferably has a similar door on the back side so that the oven is accessible from either side and can also be well lighted with natural room light. Optionally below the oven is a dish warming rack 29 which can also serve to help support the oven unit 28. The oven unit has an auxiliary warming top 34 which is warmed by exiting smoke which can circulate around four sides of the oven before exiting through smoke outlet 36.

Figure 3:
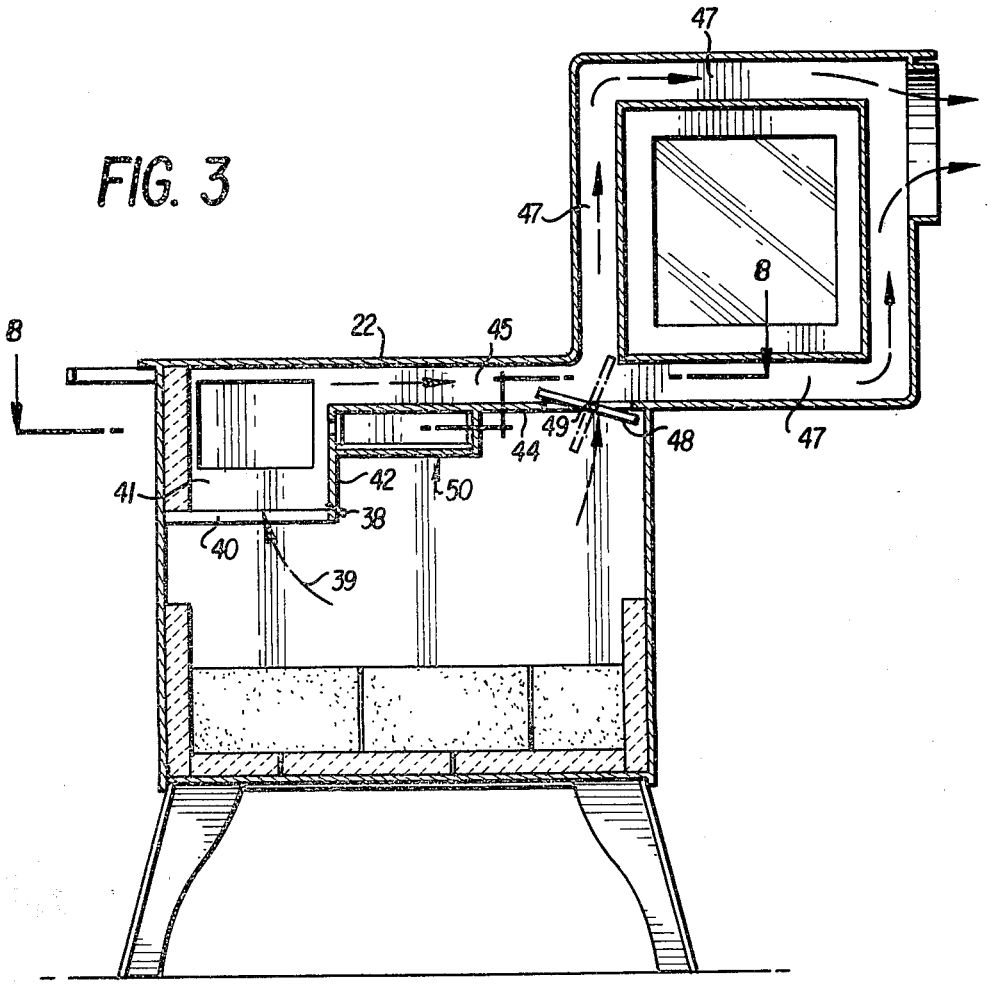
FIG. 3 is a front sectional view of the stove shown in FIG. 1.

Referring now to FIG. 3, there is shown a baffle generally designated 38 having a first perforate portion 40 forming an auxiliary firebox 41 and a second imperforate portion 44 defining an exit smoke passage 45 between it and the cooking top 22. The vertical portion 42 of the baffle is used in conjunction with the air inlet duct generally designated 50 in a manner which will be described later in greater detail. A moveable baffle 48 is pivoted about a shaft 49 so that exiting smoke can either be directed through the perforated first portion 40 of the baffle and subsequently through the auxiliary firebox 41 as indicated by arrow 39 or, alternatively, the exiting smoke can be "short circuited" as indicated by arrow 37 when baffle 48 is in the position shown in dotted lines.

Normally the baffle 48 is always maintained in the closed position, that is as shown in solid line, except when the main door 24 is about to be opened. At that time it is desireable to move baffle 48 to the position shown in dotted lines by turning handle 46 (see FIG. 1) so as to avoid the possibility of any smoke coming out through the open door. This is because the lower edge of the auxiliary firebox 41 will usually extend below the top edge of door 24 and thus the normal smoke path, as indicated by arrow 39, would lead the smoke past the open door. The baffle is not generally used for heat control as it has been found in normal usage that the level of heat both on the cooking top and in the oven can better be controlled by governing the quantity of incoming air rather than adjustment of baffle 48. However, if needed, movable baffle 48 can be used also to control the level of heat to bypass smoke passage 45.

It is apparent from FIG. 3 that when movable baffle 48 is in its normal (generally horizontal) position, the exiting smoke will move around four sides of the oven and it has been found in normal practice that simply by use of a uniform width of approximately two inches in each of the four air passages 47, that even heating in the oven is readily obtained. Shaft 49 is located off center in relation to the width of moveable baffle 48 so that the baffle is heavier on the left side, as shown in FIG. 3, tending to self bias it to either position.

Attention is now directed to FIGS. 4–6 and 8 in connection with the operation of the air inlet means, generally designated 50. The volume of incoming air controlled by moving two slidable doors 51 and 52 (see FIG. 1) and that incoming air travels through duct 57 in the direction of arrow 59 and across the top of the interior of the firebox thus becoming warm to promote greater combustion efficiency. The incoming air then travels down the back of the main firebox through duct 53 defined between rear baffle 64 and rear wall 66. The rear baffle terminates in an open end about 10 inches above the bottom of the firebox so that the incoming air is discharged immediately behind the burning logs. The logs are preferably placed in the firebox so that their ends face toward the door 24 thus promoting a flow of air directly between the logs. The path of the air flow and exiting smoke then follows arrow 39 as previously described.

Figure 4:
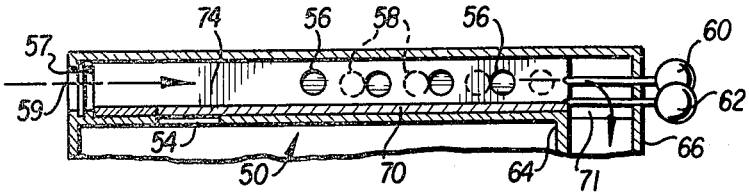
FIG. 4 is a section view taken along line 4—4 of FIG. 8 to show the air inlet duct and adjustment means.
Figure 5:
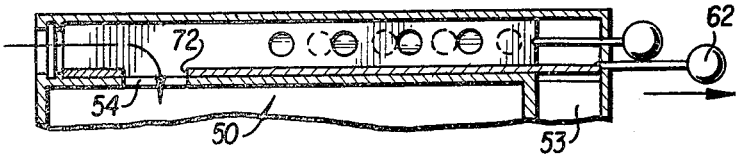
FIG. 5 is a view similar to FIG. 4 but showing the air inlet adjustment means in a second position.
Figure 6:
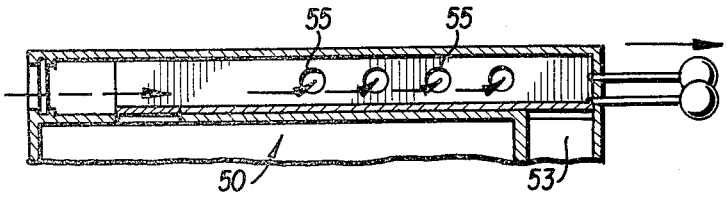
FIG. 6 is a view similar to FIG. 4 but as showing the air inlet adjustment means in a third position.

The air inlet 50 means has two separate sliding members for directing the incoming air flow by manipulation of handles 60 and 62 which project preferably from the rear of the stove. When both handles 60 and 62 are pushed in as shown in FIG. 4, the air flow enters the main firebox through ducts 57 and 53 as previously described. However, when handle 62 is pulled all the way out as shown in FIG. 5 then duct 53 is blocked and the incoming air can enter the main firebox only through opening 54 as shown by the arrow in FIG. 5. This position is used to induce a hot flame immediately inside main door 24 so as to burn off the accumulation of any deposits on the inside of Vycor glass 26. This burning off process is facilitated by another aspect of this invention which will be later described. When, as shown in FIG. 6 both handles 60 and 62 are pulled all the way out, then first and second air exit openings 53 and 54 are both blocked and no incoming air can flow to the main firebox. The main fire can then be starved of air and subsequently extinquished. Instead the third exit, comprising openings 56 and 58 will align as shown in FIG. 6 so that the sole entry path for the incoming air is to follow arrows 55 to be carried sideways directly through vertical wall 42 and into the side of auxiliary firebox 41.

Figure 7:
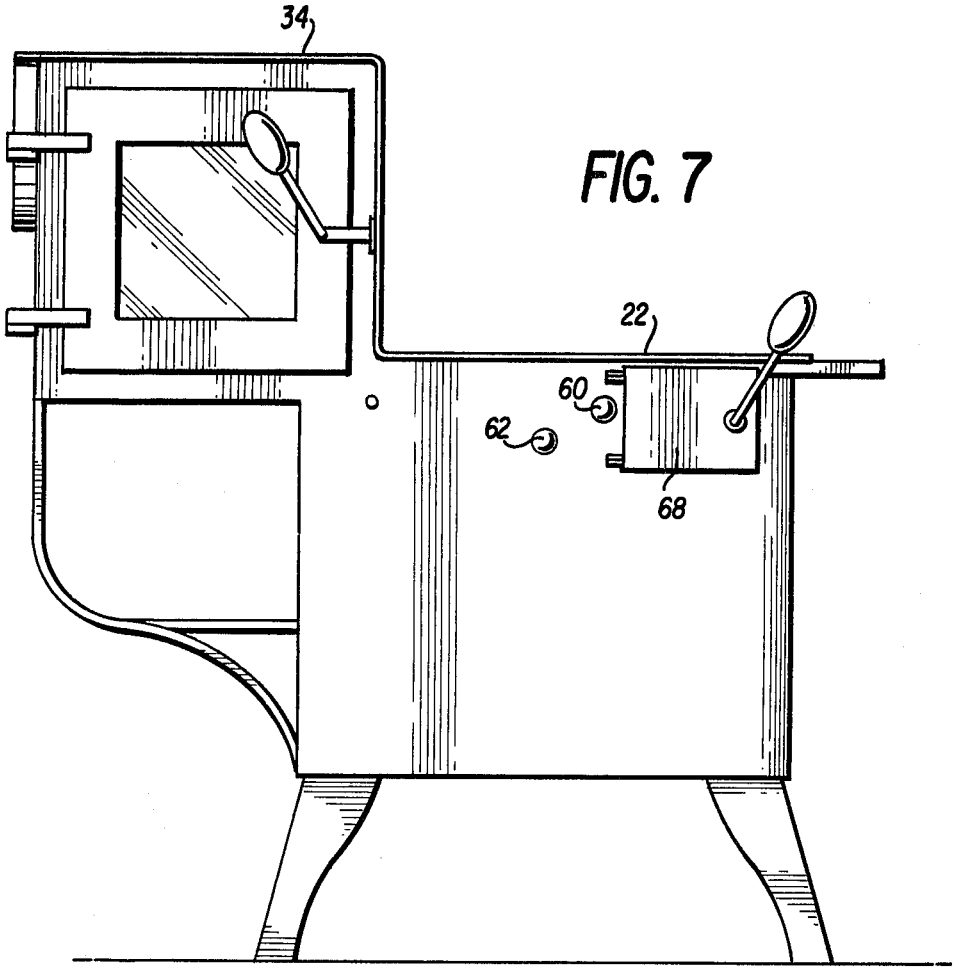
FIG. 7 is a rear elevational view of the stove of FIG. 1.

Thus if one desires to switch from a large fire used for heating to a smaller fire used only for cooking, small pieces of wood can be inserted directly into auxiliary firebox 41 by means of auxiliary firebox door 68 which is at the back of the stove (see FIG. 7). As previously described the normal flow of smoke is indicated by arrow 39 and thus even if damp wood is put in the auxiliary firebox, it will soon be dried and ready for burning. When it is desired to use the auxiliary fire alone, after ignited by main fire, it is only necessary to pull both handles 60 and 62, cutting off the air to the main firebox and immediately injecting a large quantity of incoming air directly into the auxiliary firebox.

Figure 8:
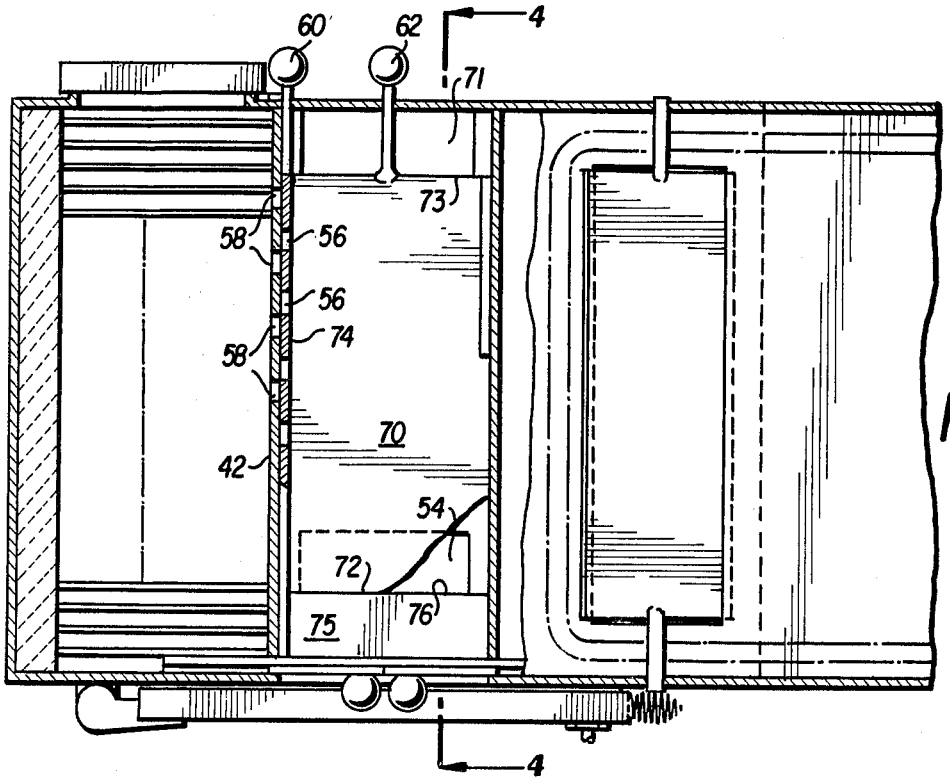
FIG. 8 is a sectional view taken along line 8—8 of FIG. 3 to show the inlet air duct and its adjustment means and the fixed and movable baffles.

The understanding of the operation of the air inlet control means will be facilitated by reference to FIG. 8 which shows, by means of a sectional view along line 8—8 of FIG. 3, the operation of the air inlet control means in greater detail. A first air exit opening, in the form of a rectangular opening 54 is adjacent the front of the stove, being spaced from the front of the stove by a distance approximately equal to its front to back dimension. A second air exit opening 71, of approximately the same front to back dimension as the opening 54 is at the rear of the air passage, just above rear air duct 53. A primary axially slidable member 70 lies along the bottom of the air passage, its length being just great enough so that its front edge 72 will close opening 54 when its rear edge 73 is clear of opening 71. When member 70 is pulled toward the rear of the stove (to the right in FIGS. 4–6) the second opening 71 will be completely blocked just as the first opening 54 becomes unblocked, in other words, the length of member 70 is equal to the distance between the front edge of first opening 54 and the front edge of second opening 71.

A secondary axially slidable member 74 has a plurality of openings 56 which, when the member 74 is pulled to the right as shown in FIG. 6 will line up with openings 58 in the vertical wall 42. When member 74 is pushed to the left as shown in FIGS. 4 and 5 (or as in FIG. 8) then openings 56 and 58 are not in alignment and these air passages are blocked. Member 74 has an extending portion 75 projecting at a right angle therefrom and, when member 74 is pushed toward the front (to the left in FIGS. 4 and 5) then portion 75 lies in the area between first opening 54 and the front wall of the main firebox unit. When member 74 is pulled to the rear as shown in FIG. 6, then portion 75 overlies opening 54 so as to block off that air exit. In addition, the rear edge 76 of portion 75 is in coplanar contacting and abutting relationship to front edge 72 of member 70. Thus when handle 60 is pulled outwardly from the rear of the stove (to the right as shown in FIG. 6) then rear edge 76 will contact front edge 72 and the single movement of handle 60 will move not only member 74 but also member 70 and its handle 62. Thus merely by pulling handle 60 one can move both members 70 and 74 and change over the stove from the main firebox burning mode to the auxiliary firebox burning mode, with both exits 54 and 71 being blocked to prevent any air flow to the main fire but with openings 56 and 58 being placed in alignment so as to permit air flow into the auxiliary firebox.

The auxiliary firebox is used primarily for cooking purposes when only a small fire is needed. Because it is located directly above the main fire box, ashes from that fire will drop directly into the main fire box where they can be easily removed. If one desires to extinguish the auxiliary fire and switch back to the main fire box, it is only necessary to push in on handles 60 and 62 to redirect the air for that purpose.

Figure 9:
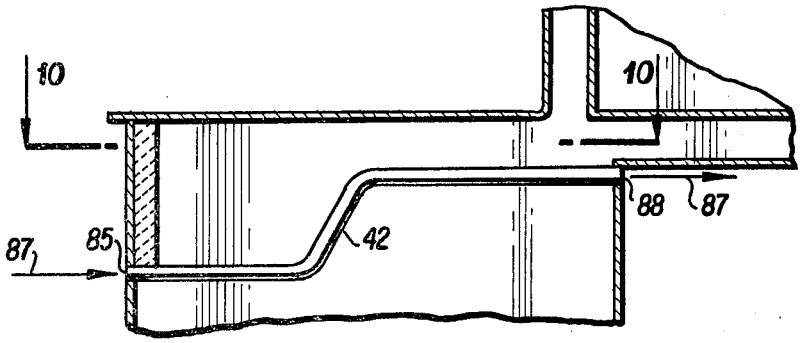
FIG. 9 is a sectional view showing an optional baffle grate.
Figure 10:
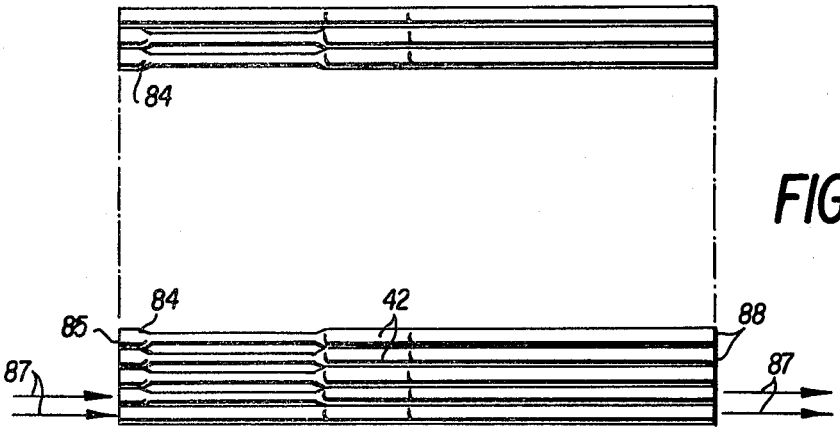
FIG. 10 is a view taken along line 10—10 of FIG. 9 showing a top view of the optional baffle grate; and, FIG. 11 is a view similar to FIG. 10 but showing an optional water heating pipe as part of the baffle grate.
Figure 11:
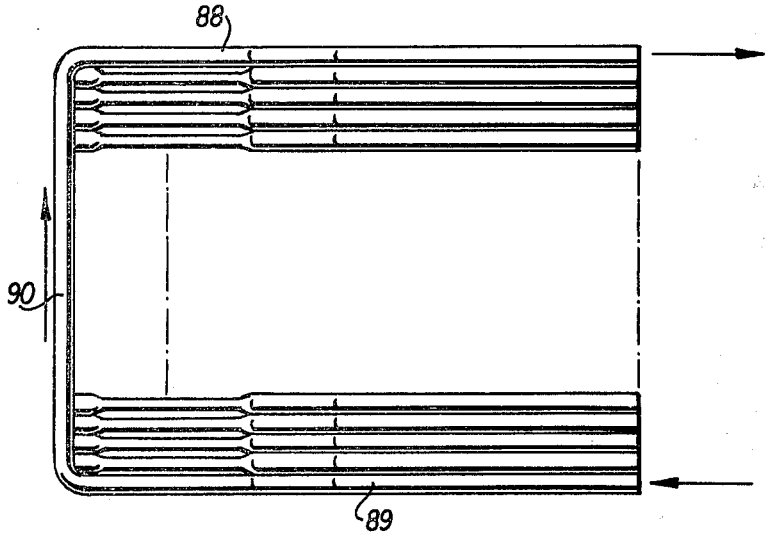

Turning now to FIGS. 9–11, there is shown a baffle grate which can be alternatively used in place of baffle 38. FIG. 9 is an elevational view similar to what might be seen in FIG. 3 if only the portion illustrating the baffle 38 were shown. In this instance instead of a planar sheet of metal being bent to form the grate, the grate is instead formed of a plurality of adjacent tubular elements. Each element is preferably straight when viewed in plan (as in FIGS. 10 and 11) and a plurality of them, (perhaps 15 or 20) are placed in close side by side contiguous contact and welded together at their ends so as to form a baffle grate in a manner which will now be described.

Each element of the baffle grate is preferably of the same cross sectional shape and that shape may be square, rectangular, or circular. In each case the baffle grate has a first imperforate portion where the cross sectional shape of each tubular element has not been deformed, and thus when the elements are held together, they will lie in contiguous side by side contact. In a second imperforate portion, preferably comprising about one third of the length of the baffle grate, the cross sectional shape of a majority (and preferably all) of the tubular elements has been modified so that when the tubes are placed side by side, elongated openings will be left between them. In a tubular element which was originally of square cross section the deformed cross section would be rectangular or oblong and in a tubular element which had originally been of circular cross section the deformed portion would be oblong. In each case the effect is the same, a plurality of elongated openings are left between the deformed tubes.

Preferably the distal ends of the tubes are left in an undeformed shape to facilitate assembly of the grate element, including welding between adjacent distal ends.

Preferably all of the elements of the baffle grate are bent as shown in elevation in FIG. 9 so as to present a substantially vertical wall 42 similar to that of FIG. 3. However, to avoid decreasing the cross sectional interior area of the elements at their points of bending, the wall 42 is at a slight angle away from vertical. The baffle grate can be used in any type stove but, for example considering the present stove, it would be placed in the same manner as baffle 38 shown in FIG. 3, that is to define a smoke exit between its imperforate portion and the top of the firebox unit and, in its perforate portion, to define an auxiliary firebox in the area where the tubes are bent downwardly away from the top 22. The elongated openings between the deformed tubes in the perforate area act the same as the openings between adjacent bars in an ordinary grate, permitting the ashes in the auxiliary firebox to fall back into the main firebox after the wood has been burnt.

All of the ends of the tubular elements are open on each side of the stove as shown for example at reference numerals 85 and 86 in FIG. 9, thus permitting a flow of air therethrough as shown by the arrows 87.

Figure 2:
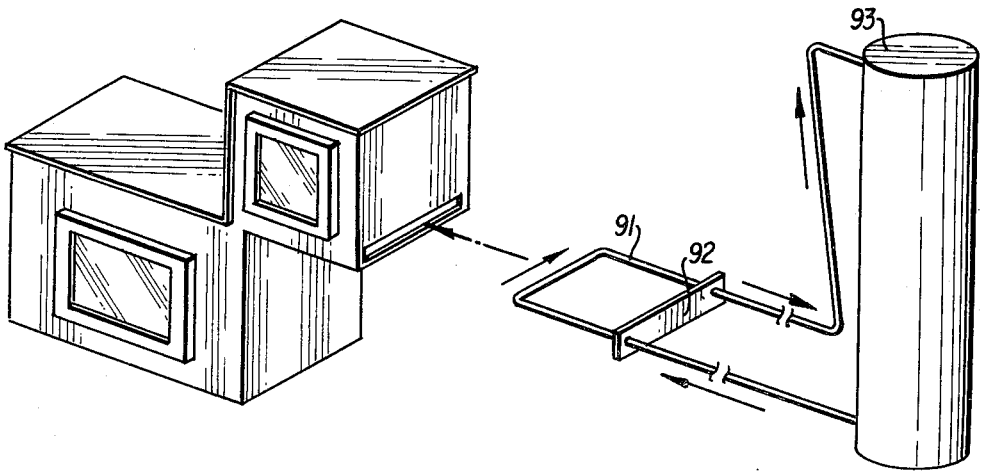
FIG. 2 is a diagramatic perspective view of the present stove to show the attachment of an optional auxiliary water heating device.

Referring now to FIG. 11, two or more of the tubes, for example outside tubes 88 and 89 can be connected together by a header 90 so as to form a closed circuit for circulation of a fluid therethrough, for example for use as a water heater circulation loop similar to that shown in FIG. 2. That water heater could either be used in connection with the baffle grate of FIGS. 9–11 or simply as an auxiliary in connection with a metal plate baffle as shown in FIG. 3. In either case the loop 91 would project into exit smoke passage 45. A suitable plate 92, having a close fitting hole for each of the fluid circulating tubes would be used in place of a removable plate on the side of the oven unit. In any case a suitable storage tank 93, having a cold water inlet and a hot water outlet (not shown) would also be used.

As previously mentioned the main firebox door 24 has a glass panel 26 made of a special high temperature heat resistant glass such as Corning Vycor (trademark) which serves the dual purpose of permitting viewing of the fire and also greatly facilitating the emission of radiant heat from the firebox. However, when the fire is allowed to burn low, such as at night, creosote can form on the inside of the glass, greatly diminishing its heat radiant value and aestetic effect. This creosote will burn off after exposure to temperatures above 700° F. but that burning off process can be time consuming. The present inventor has found that the cleaning process can be greatly facilitated by the provisions of a stainless steel plate 96 which is shown in FIG. 1. That plate is preferably of eighth inch thick polished stainless steel having a high heat reflecting capability. The stainless steel plate is cut so as to fit within the "frame" around the window 26 and one end is placed behind fastener 97 while the door handle is pivoted so as to rotate disk 98 and place the flat spot 99 thereon parallel with the edge of the window frame. The stainless steel plate is then pushed up close to the glass and the handle is again rotated so that the flat spot returns to its normal position, with the round edge of the disk 98 then holding the stainless steel plate in place.

The plate can remain in place during the night when the fire is burning low and creosote is forming and then, in the morning, after new wood is added a hot fire will soon burn off the creosote. This burning off is greatly facilitated by the provisions of the air inlet control means which have already been described, that is after the fire is burning nicely, handle 62 is pulled partly outward so as to divert some of the incoming air from second opening 71 to the first opening 54. The flow of new air in that area will mix with hot gases coming up from the burning wood and form a very hot turbulent fire directly inside the door glass 26. The stainless steel plate reflects that heat back into the firebox placing the glass under very high temperature and burning the creosote off in a very short period of time.

A preferred embodiment of this stove has been constructed of ¼ inch and 5/16 inch HR steel having a height of 48 inches, a length of 46 inches and a depth of 22 inches. The main firebox measures 23 by 17 and the auxiliary firebox, 18½ by 8 inches. The main fire door opening is 9 by 15 inches and the auxiliary fire door opening is 5 by 7 inches. The total cook surface is 41 by 22 and the height to the cooking surface is 32 inches. A ⅛ inch polished stainless steel plate is used over the Vycor door glass and the main firebox is lined with fire brick on both the sides and bottom thereof. All of the doors have fiberglass gaskets and chrome wire knobs are used on the door and air controls to facilitate handling when the stove is hot. The stove stands on legs to facilitate cleaning thereunder and also to promote air circulation to prevent overheating of the floor. Because of the provision of the auxiliary firebox and the air inlet means which can proportion air between the two fireboxes or divert all of the air to the auxiliary firebox, it is possible to use the stove for cooking purposes even during summer months. Having now described a preferred embodiment of this invention, which is given by illustration and not limitation, I desire to secure exclusive protection as defined in the following claims.

I claim:

1. A wood burning stove comprising an airtight body having a lower firebox unit and an upper oven unit, the oven unit being in vertically offset relationship to the firebox unit so as to have an air passage within one of its walls overlapping one of the walls of the firebox unit;

a main fire door at the front of the firebox unit;

a closeable air inlet opening near the top of the front of the firebox unit in communication with an air inlet duct running generally horizontally across the top of the interior of firebox unit and then vertically downwardly along the back wall of the interior of the firebox unit;

a generally horizontal cooking top on said firebox unit;

a baffle within the upper portion of the firebox unit and extending generally parallel to the cooking top to define an exit smoke path across the top of the interior of the main firebox and extending toward the junction with said vertically offset oven unit;

said baffle having a first perforate portion remote from the said junction defining an auxiliary firebox in the upper portion of the main firebox and directly below said cooking top; said baffle having a second imperforate portion adjacent the connection with said oven unit;

said oven unit having a smoke outlet in its upper portion remote from the junction with the firebox unit and open passages in its walls therebetween so that smoke can flow freely from said main firebox unit, through said auxiliary firebox, under the cooking top and through the open passages to the smoke outlet.

2. The stove of claim 1 in which the second imperforate portion of the baffle has a moveable damper therein positioned adjacent the junction with the oven unit so that smoke can pass directly to the open passages in the oven unit walls without going through the auxiliary firebox and exit smoke path.

3. The stove of claim 1 in which the baffle has an offset in its central portion to define two levels thereon, said first perforate portion being spaced a greater distance from said cooking top than said second imperforate portion.

4. The stove of claim 3 in which the offset has a generally vertical wall and the air inlet duct is adjacent thereto, the vertical wall forming one sidewall of the duct.

5. The stove of claim 4 in which the horizontal air inlet duct includes means for communicating inlet air through said generally vertical wall directly to said auxiliary firebox.

6. The stove of claim 5 in which the air inlet means has three separate opening means, the first being a passage connectable to said vertically downwardly extending portion, the second being a passage connectably to the front of said main firebox immediately above the main door and the third being at least one slideably closeable opening through said vertical wall connected to said auxiliary firebox.

7. The stove of claim 6, including manual operable control means to selectively direct inlet air to any one of said separate openings.

8. The stove of claim 6, including manual operable means to selectively direct inlet air to any two of said separate openings.

9. The stove of claims 7 or 8 in which said manual operable control means is a slideable portion of said air duct having external control handles.

10. The stove of claim 1, 2 or 3, including a water heating coil positioned in the upper portion of said firebox unit and extending into said exit smoke path so as to be warmed from either the auxiliary or main fireboxes.

11. The stove of claim 1 in which the horizontal air inlet duct is adjacent the baffle and includes means for communicating inlet air directly to said auxiliary firebox.

12. The stove of claim 11 in which the air inlet means has three separate openings, the first connectable to said vertically downwardly extending portion, the second connectably to the front of said main firebox and the third connectable to said auxiliary firebox.

13. The stove of claim 12, including manual operable control means to selectively direct inlet air to any one of said separate openings.

14. The stove of claim 12, including manual operable means to selectively direct inlet air to any two of said separate openings.

15. The stove of claims 13 or 14 in which said manual operable control means is a slideable portion of said air duct and having external control handles.

16. An air inlet control means for a wood burning stove having an auxiliary firebox and a main firebox separated therefrom by a baffle, said inlet control means comprising:

an elongated air passage having at least two elongated parallel walls and an air inlet opening at one end;

a first air exit opening adjacent the other end in one of said walls for communicating with a first portion of said main firebox;

a second air exit opening in one of said walls adjacent the air inlet for communicating with a second portion of said main firebox;

a third air exit opening in one of said walls for communicating with said auxiliary firebox;

a primary axially slideable member on said elongated passage and mounted to be slideable from a first position closing said second exit and opening said first exit to a second position closing said first exit and opening said second exit;

a secondary axially slideable member on said elongated passage and mounted to be slideable from a position closing said third exit to a position opening said third exit.

17. The air inlet control means of claim 16, including a portion extending from said secondary member and positioned to close one of said first and second exits when said third exit is open.

18. The air inlet control means of claim 17 in which said extending portion is in contacting relation with said primary member so that movement of said secondary member to open said third exits will close one of said first and second exits.

19. The air inlet control means of claim 17 in which said extending portion is adjacent said second opening and positioned to contact and move said primary member so that movement of said secondary member will open said third exit, close said second exit and move said primary member to close said first exit.

20. The air inlet control means of claim 16 in which said first and second exit openings are in the bottom wall of said passage and said third exit is in a side wall of the passage.

* * * * *